US006808584B2

(12) United States Patent
Käsbauer

(10) Patent No.: US 6,808,584 B2
(45) Date of Patent: Oct. 26, 2004

(54) METHOD AND APPARATUS FOR APPLYING A LAYER OF LACQUER TO AN UPPER SIDE OF A PRINTED MEDIUM

(75) Inventor: Hans Käsbauer, Berg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/292,845

(22) Filed: Nov. 12, 2002

(65) Prior Publication Data

US 2003/0116263 A1 Jun. 26, 2003

Related U.S. Application Data

(63) Continuation of application No. PCT/EP01/05273, filed on May 9, 2001.

(30) Foreign Application Priority Data

May 11, 2000 (DE) ..... 100 22 939

(51) Int. Cl.[7] ..... B32B 31/12; B32B 31/28

(52) U.S. Cl. ..... 156/231; 156/247; 156/277; 427/146

(58) Field of Search ..... 156/230–241, 156/247, 277, 289; 427/146–148

(56) References Cited

U.S. PATENT DOCUMENTS

| | | | | | |
|---|---|---|---|---|---|
| 4,370,291 | A | * | 1/1983 | Kazama et al. | 264/210.7 |
| 4,840,757 | A | * | 6/1989 | Blenkhorn | 264/485 |
| 5,002,007 | A | * | 3/1991 | Jahn | 118/46 |
| 5,368,891 | A | | 11/1994 | Sagara et al. | |
| 5,406,641 | A | * | 4/1995 | Bigley et al. | 385/141 |
| 5,425,970 | A | * | 6/1995 | Lahrmann et al. | 427/493 |
| 6,042,675 | A | * | 3/2000 | Kim | 156/230 |
| 6,395,120 | B1 | * | 5/2002 | Bradbury-Harris et al. | 156/230 |

FOREIGN PATENT DOCUMENTS

EP 0 343 794 A2 11/1989

* cited by examiner

*Primary Examiner*—Richard Crispino
*Assistant Examiner*—Sing Po Chan
(74) *Attorney, Agent, or Firm*—Laurence A. Greenberg; Werner H. Stemer; Ralph E. Locher

(57) ABSTRACT

A method and apparatus apply a lacquer layer to the upper side of a printed medium (i.e. a printed sheet). The method and apparatus form a film of lacquer, in particular a UV lacquer film. Next, the lacquer film is dried or hardened under the action of heat and/or UV radiation. Next, the dried/hardened lacquer film is transferred to the (fresh or still wet) printed upper side of the printed medium, with simultaneous permanent adhesion of the film to this upper side.

46 Claims, 3 Drawing Sheets

METHOD AND APPARATUS FOR APPLYING A LAYER OF LACQUER TO AN UPPER SIDE OF A PRINTED MEDIUM

CROSS-REFERENCE TO RELATED APPLICATION

This application is a continuation of copending International Application No. PCT/EP01/05273, filed May 9, 2001, which designated the United States and was not published in English.

BACKGROUND OF THE INVENTION

Field of the Invention

The invention relates to a method of applying a layer of lacquer to an upper side of a printed medium, as well as to a corresponding apparatus.

In particular, in digital photography, the digital photographs must be printed. The result of such printing does not always look particularly attractive. The paper used for printing has a dull rather than shiny finish. It is especially disadvantageous in preparing a prospectus or similar document if a shiny print cannot be produced directly or suitable printing paper is not available or, for example, if a printer is used that cannot generate such prints.

Thus there are a number of situations associate with the preparation of printed documents in which it is desirable to cover the material with a glossy layer after it has been printed, for instance with a thin layer of lacquer, so that the print will have a more pleasant, attractive appearance.

The so-called lamination technique has conventionally been used for this purpose. A piece of cellophane or PVC film to which a layer of adhesive has been applied is placed on the printed upper side of a printed medium, so as to obtain a glossy surface. This method cannot readily be implemented inside a printing machine. The adhesive-coated PVC or cellophane film is pulled off a roll and cut to shape, so that it can then be placed on the printed side of the printed medium, in particular rolled onto the surface. It is important here to avoid air inclusions. For the procedural steps just described, separate devices are needed to store the film, retrieve it from storage and put it into position. The mechanical technology required is extremely elaborate.

As an alternative, in the so-called "wet-in-wet" method, dispersion lacquer is applied to the upper side of a printed medium while it is still wet, i.e. has just been printed. This is followed by drying, as the medium is transported over a relatively long distance, 4 to 8 m, under IR irradiation. In this method, it very often happens that the lacquered surface becomes dull, as a result of etching of the lacquer layer from the color side. Furthermore, in this method, very elaborate mechanical technology is again needed. In particular, because the drying segment of the process requires transport over such a long distance, the machinery can be installed only in correspondingly large buildings or factory halls.

SUMMARY OF THE INVENTION

It is accordingly an object of the invention to provide a method and an apparatus for applying a layer of lacquer to an upper side of a printed medium that overcome the hereinafore-mentioned disadvantages of the heretofore-known devices of this general type and that apply a layer of lacquer to the upper side of a printed medium to ensure a glossy finish of high quality with an extremely short processing distance, and can employ the wet-in-wet procedure, so as also to enable a so-called façon lacquering without problems.

With the foregoing and other objects in view, there is provided, in accordance with the invention, a method of applying a lacquer layer to an upper side of a printed medium. The first step of the method is forming a lacquer film. The next step is drying and/or hardening the lacquer film by at least one of heating and UV radiating the lacquer film. The next step is transferring the dried lacquer film to the freshly-printed upper side of the printed medium while simultaneously permanently adhering the lacquer film to the upper side.

With the objects of the invention in view, there is also provided an apparatus for applying a lacquer layer to an upper side of a printed medium. The apparatus includes a lacquer-transferring unit for producing a lacquer film and has a lacquer-transferring station and a radiator disposed downstream of the lacquer-transferring station. The lacquer-transferring station transfers the lacquer film to the upper side of the printed medium.

The crucial aspect of the present invention is thus that within a printing machine a lacquer film corresponding to a thin sheet of cellophane, in particular a nitro- or UV-lacquer film is produced from lacquer, this film is then dried or hardened under the action of heat and/or UV radiation, and subsequently it is transferred to the (fresh or still wet) printed upper side of a printed medium, becoming simultaneously glued to this upper side. In this way, it is possible without problems to provide a "façon" type of lacquering, i.e. a lacquering only in regions covering part of the printed upper side of the printed medium. As a result of the drying or hardening of the lacquer, a film of lacquer is obtained that is equivalent to a cellophane film in that it does not "run", i.e. blend with the still-wet ink on the printed medium.

Once the film of lacquer has dried or hardened, an adhesive, in particular UVC adhesive, can be applied to to form a film that is a composite of lacquer and adhesive. Subsequently, the composite film can be transferred, with the adhesive side down, onto the printed upper side of the printed medium.

Preferably, the adhesive is hardened, in particular by using infrared or ultrasound—either immediately after application to the lacquer film or after the lacquer-adhesive composite film has been transferred to the upper side of the printed medium.

To form a glossy lacquer surface, lacquer is first applied to a transfer surface, in particular a transfer drum, that is highly polished, preferably has a ceramic coating. The transfer to the upper side of the printed medium is then done in such a way that the side of the lacquer film that is apposed to the highly polished, in particular ceramic surface, defines the upperside of the lacquered printed medium, i.e. the side that is viewed.

A ceramic-coated transfer surface has the advantage that once the lacquer film has hardened, it can be released therefrom with no problems, without impairing the glossy surface of the lacquer film.

In the case of a so-called façon lacquering, a lacquer-adhesive composite film is produced on only a specified region of the transfer surface, so that it can then be transferred or applied to the desired region of the printed upper side of the printed medium.

Experience has shown that the use of adhesive can be eliminated when the lacquer film is adjusted to a prespecified temperature, in particular about 80°–110° C., at which it is hardened but nevertheless remains self-adhesive with respect to surfaces at lower temperature. In this situation it can be released from the highly polished transfer surface without difficulty and immediately transferred to the (fresh or still wet) printed upper side of the printed medium so as to become intimately joined thereto.

As an alternative to the above-mentioned embodiments of the method (lacquer-adhesive composite film or warming of the adhesive to a prespecified temperature), the dried or hardened lacquer film can be transferred to a printed upper side of the printed medium that has already been provided with adhesive. The adhesive can then be hardened after application to the film to printed upper side of the printed medium. Preferably, this hardening is brought about by the action of heat and/or UV radiation.

In accordance with a further object of the invention, a preferred apparatus for implementing the method includes a lacquer-transferring unit that is constructed for production of a lacquer film and includes a lacquer-transferring station, after which is disposed a station for hardening the lacquer, in particular in the form of a heating or UV-irradiation device; the lacquer film thus produced can then be transferred to the upper, i.e. printed side of the printed medium. The lacquer-transferring device includes a highly polished transfer surface, in particular a ceramic, stainless-steel, or chromium surface, for the reasons explained above.

In a preferred embodiment of the apparatus in accordance with the invention, the lacquer-transferring device includes a transfer drum, the surface of which is made of highly polished stainless steel, chromium, or non-ferrous materials, in particular ceramic.

In a preferred embodiment of the apparatus, the lacquer-transferring unit also includes an adhesive-transferring station disposed after the lacquer-transferring station. Between these two stations the radiation device is situated, e.g. a heat or UV radiator. As a result, a lacquer-adhesive composite film is formed that can be transferred to the printed upper side of the printed medium.

In an alternative embodiment of the apparatus, an adhesive-transferring station to transfer a film of adhesive to the upper side of the printed medium can be disposed ahead of the lacquer-transferring unit. In this case the lacquer-transferring device is used to apply the film of lacquer to the upper side of the printed medium after the latter has been provided with a film of adhesive. An adhesive-hardening device is preferably also disposed between the adhesive-transferring station and the lacquer-transferring device.

An adhesive-drying device is included in the lacquer-transferring unit, downstream of the adhesive-transferring station. Preferably, the adhesive-drying device is positioned after the transfer station in which the lacquer film or lacquer-adhesive composite film is applied by way of its adhesive side to the upper side of the printed medium.

It has proved especially advantageous to use as adhesive-drying device a UV radiator, an IR radiator or an ultrasound generator.

The transfer of the lacquer film or lacquer-adhesive composite film is preferably performed in a gap between the transfer surface and a counter-roller.

For "façon"-type lacquering the lacquer and, where appropriate, the adhesive, are applied in a corresponding manner, e.g. with a high-pressure cylinder, only to specified regions of the transfer surface in the lacquer-transferring unit.

Other features that are considered as characteristic for the invention are set forth in the appended claims.

Although the invention is illustrated and described herein as embodied in a method and apparatus for applying a layer of lacquer to the upper side of a printed medium, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
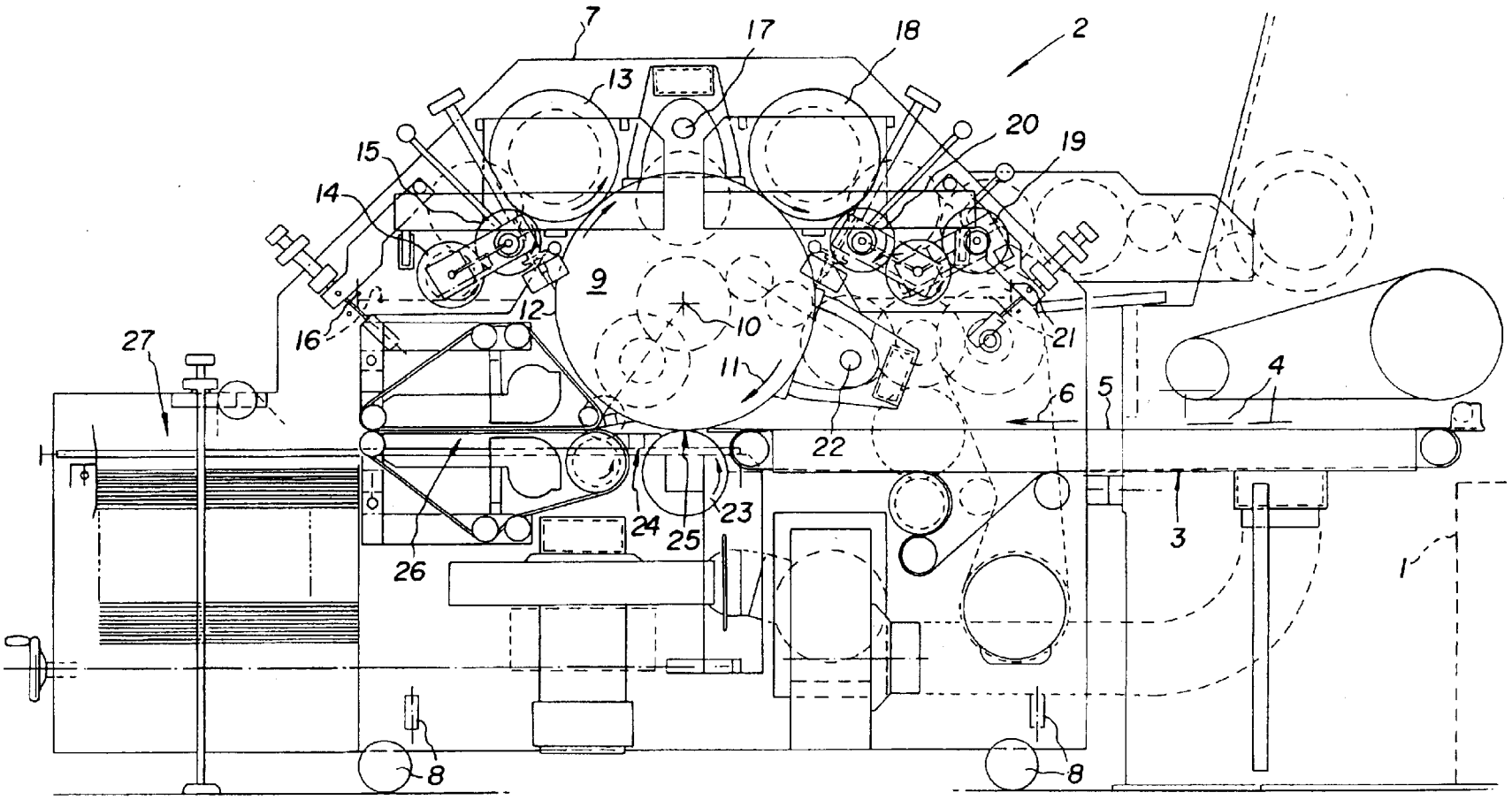
FIG. 1 is a diagrammatic longitudinal section view showing a first exemplary embodiment of an apparatus for transferring a lacquer-adhesive composite film in connection with a printing unit according to the invention.
Figure 2:
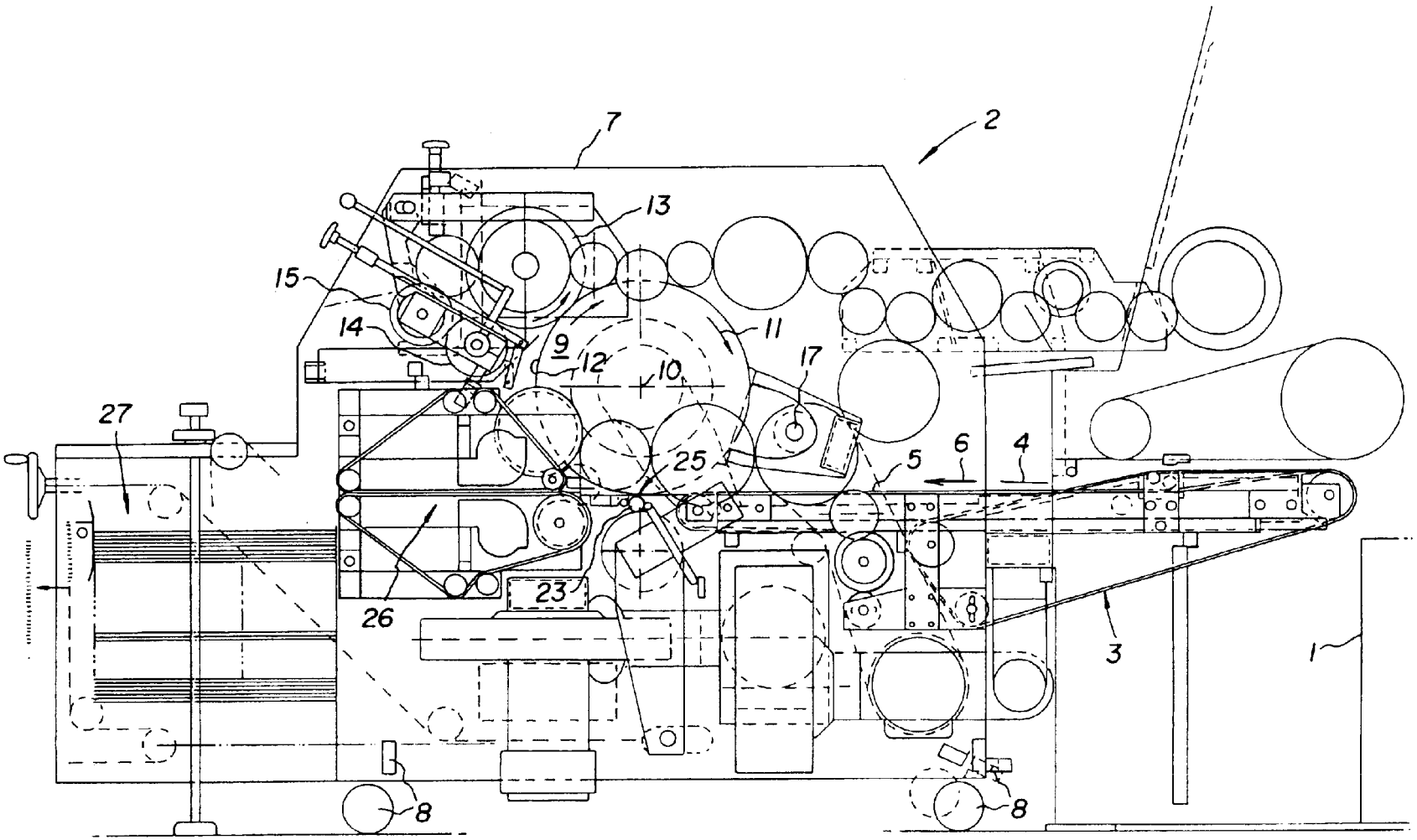
FIG. 2 is diagrammatic longitudinal sectional view showing a second exemplary embodiment of an apparatus corresponding to FIG. 1, but without a device for applying an adhesive.

Referring now to the figures of the drawings in detail and first, particularly to FIGS. 1 and 2 thereof, the reference numeral 1 identifies the exit from a printing unit, not shown in detail here, to which a lacquering unit 2 is connected. By a deliverer 3 (i.e. a conveyor belt), sheets of paper that have been printed on their upper sides in the printing unit are conveyed to the lacquering unit 2, the deliverer 3 for this purpose is a conveyor belt 5 that transports the printed sheets 4 in the direction indicated by the arrow 6. The lacquering unit 2 includes a housing 7 that is supported on feet with adjustable height and contains a central transfer drum 9 driven so that it rotates about a horizontal axis 10 in the direction indicated by the arrow 11.

In the case of the lacquering unit shown in FIG. 1, the circumferential surface 12 of the transfer drum 9 is preferably coated with highly polished ceramic. In the lacquering unit shown in FIG. 2, however, the circumferential surface 12 of the transfer drum 9 is preferably chromium-coated; if required, however, it can also be ceramic-coated or coated with another comparable material that allows the production of highly polished, continuous surfaces just as do chromium or ceramic.

The first material put onto the circumferential surface 12 in the exemplary embodiment is UV lacquer, applied by a lacquer cylinder 13. The latter is supplied with UV lacquer from a lacquer reservoir 16, by way of a scoop roller 14 and a dosing roller 15. This construction is an instance of a generally known technological configuration. The lacquer applied to the circumferential surface 12 of the surface drum 12 of the transfer drum 9 is hardened to form a film of UV lacquer, by using a UV radiator 17 disposed downstream of the lacquer cylinder 13.

In FIG. 1 the UV radiator 17 is followed by an adhesive cylinder 18, which like the lacquer cylinder, is supplied by two rollers, in this case an adhesive-scoop roller 19, which takes adhesive from an adhesive bath 21, and an adhesive-dosing roller 20.

In the embodiment shown here, the adhesive cylinder is followed by an IR radiator 22 for prehardening the adhesive layer that has been applied to the lacquer film. The lacquer-adhesive composite film thus produced on the circumferential surface 12 of the transfer drum 9 is then, in a gap between the transfer drum 9 and the associated counter-roller 23, pressed against the top, printed surface of the printed sheet 4 and becomes intimately joined thereto.

In the second exemplary embodiment, according to FIG. 2, no adhesive-transferring station is provided. Instead the lacquer is merely hardened by an IR or UV radiator 17; this hardening or drying is brought about on a transfer surface, in this case the circumferential surface 12 of the transfer drum 9, which is adjusted to a temperature of about 100° C. As a result, the lacquer film remains sticky with respect to surfaces at lower temperature, while problems with releasing the lacquer film from the transfer drum are avoided. The radiator 17 is preferably disposed immediately ahead of the gap between transfer drum 9 and associated counter-roller 23.

It can be particularly advantageous to dispose downstream of the above-mentioned transfer gap, which defines a so-called transfer station 25, a device for the final hardening of the lacquer film and/or adhesive. An ultrasound generator is a particularly preferred device for the final hardening. In this embodiment, the final hardening of lacquer and/or adhesive thus does not occur until after the lacquer film or lacquer-adhesive composite film has been transferred to the printed surface of the printed sheet 4. This procedure has the advantage that in the gap between transfer drum 9 and counter-roller 23 any air inclusions that may be present can be pressed out of the region between the lacquer film or lacquer-adhesive composite film and the printed surface of the printed sheet 4 with no problems. The not yet prehardened, and hence still relatively soft lacquer and/or adhesive layer presents no resistance to escaping air inclusions. Downstream of the transfer station a device for the final hardening of the lacquer and/or adhesive layer is disposed, indicated in FIGS. 1, 3, and 5 by the reference numeral 24.

Transport of the lacquered printed sheets 4 away from the station is achieved by conventional devices, namely a conveyor-belt device 26 leading to a conventional stapling device 27.

Figure 3:
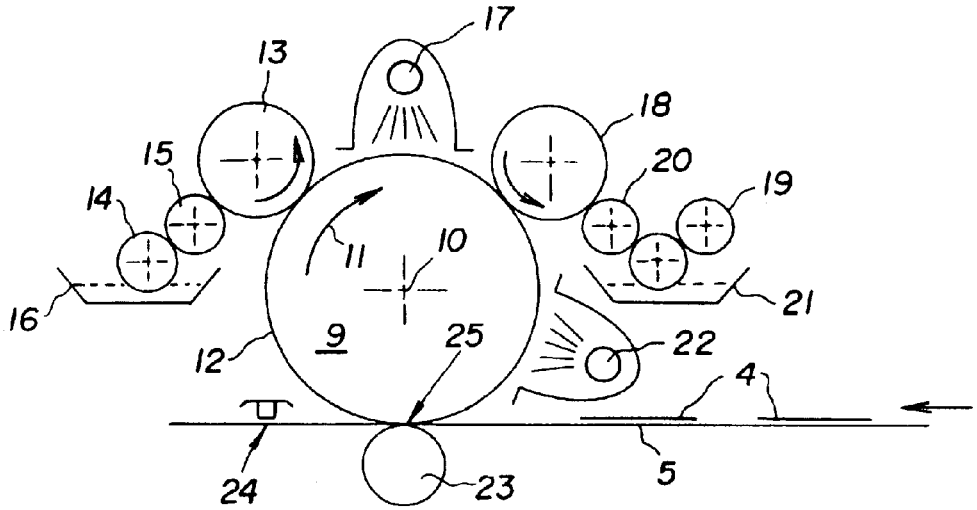
FIG. 3 is a partial diagrammatic sectional view of the first exemplary embodiment according to FIG. 1.
Figure 4:
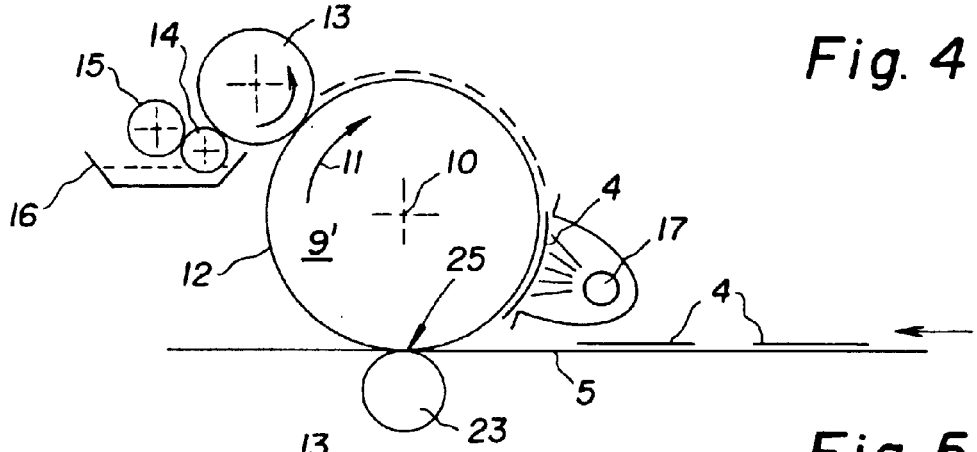
FIG. 4 is a partial diagrammatic sectional view of the second exemplary embodiment according to FIG. 2.

The two lacquering units just explained are shown again, schematically, in FIGS. 3 and 4. It can readily be seen here that the apparatus shown in FIG. 4 lacks the adhesive-transferring station 18-21 and the IR radiator 22, as well as the device 24 for hardening the adhesive layer. The unit is therefore less elaborate in construction, although a device for warming the chromium-coated circumferential surface 12 of the transfer drum 9 is required.

Figure 5:
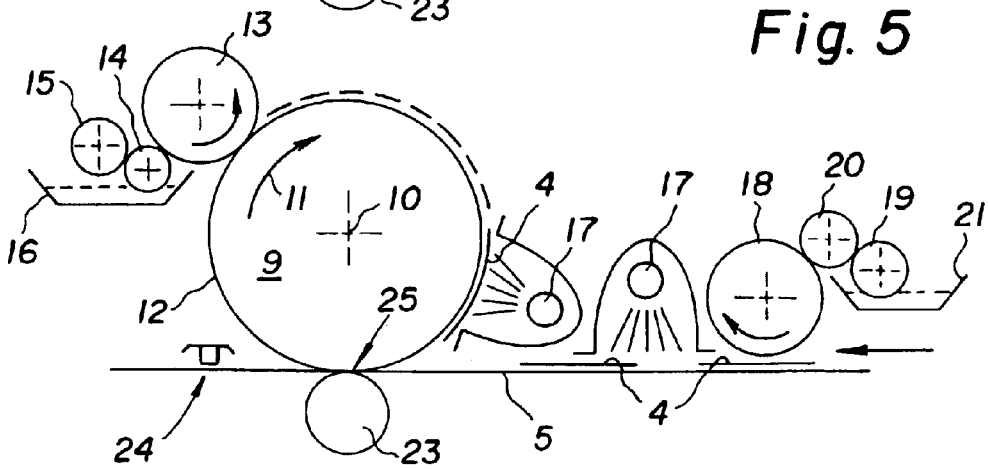
FIG. 5 is a partial diagrammatic sectional view of a third exemplary embodiment of the apparatus in question here.

FIG. 5 shows a third embodiment of a lacquering unit, an alternative to the embodiments shown schematically in FIGS. 3 and 4. Here adhesive is applied to the upper side of printed media 4 by using an adhesive-transferring station 18-21 prior to the application of a lacquer film. The adhesive is hardened immediately after application, by using an IR or UV radiator 17. Subsequently, the transfer drum 9, which has a circumferential surface 12 made of chromium or ceramic, transfers the lacquer film to the sticky upper side of the printed media 4. The above-mentioned device 24 hardens the adhesive or lacquer-adhesive composite film.

It can be seen from the preceding description and attached drawings that the lacquering can be accomplished within an extremely short distance. Thus the extent of construction required is very limited. The described apparatus allows lacquering by the so-called wet-in-wet method to be done over the shortest distance with high quality (glossy finish).

All the characteristics disclosed in the application documents are claimed as essential to the invention insofar as they are new to the state of the art individually or in combination.

I claim:

1. A method of applying a lacquer layer to a still-wet, freshly-printed upper side of a printed medium, which comprises the steps:

forming a UV lacquer film;

drying the UV lacquer film by UV radiating the UV lacquer film; and transferring the dried UV lacquer film to the still-wet, freshly-printed upper side of the printed medium while simultaneously permanently adhering the UV lacquer film to the upper side.

2. The method according to claim 1, which further comprises:

applying an adhesive to the dried UV lacquer film to form a lacquer-adhesive composite film, and subsequently transferring the lacquer-adhesive composite film to the printed medium by contacting the adhesive with the printed upper side of the printed medium.

3. The method according to claim 2, wherein the adhesive is a UV adhesive.

4. The method according to claim 2, which further comprises hardening the adhesive immediately after applying to the UV lacquer film.

5. The method according to claim 4, wherein the hardening of the adhesive is accomplished by heating.

6. The method according to claim 4, wherein the hardening of the adhesive is accomplished by irradiating with UV radiation.

7. The method according to claim 4, wherein the hardening of the adhesive is accomplished by irradiating with infrared radiation.

8. The method according to claim 4, wherein the hardening of the adhesive is accomplished by applying ultrasound.

9. The method according to claim 2, which further comprises hardening the adhesive after transferring the lacquer-adhesive composite film to the still-wet, freshly-printed upper side of the printed medium.

10. The method according to claim 9, wherein the hardening of the adhesive is accomplished by heating.

11. The method according to claim 9, wherein the hardening of the adhesive is accomplished by irradiating with UV radiation.

12. The method according to claim 9, wherein the hardening of the adhesive is accomplished by irradiating with infrared radiation.

13. The method according to claim 9, wherein the hardening of the adhesive is accomplished by applying ultrasound.

14. The method according to claim 2, which further comprises façon-type lacquering including producing the lacquer-adhesive composite film only in a specified region and transferring the lacquer-adhesive composite film to a corresponding region of the still-wet, freshly-printed upper side of the printed medium.

15. The method according to claim 1, which further comprises:

applying lacquer to a transfer surface to produce the UV lacquer film with a glossy lacquered surface apposing the transfer surface; and positioning the UV lacquer film on the still-wet, freshly-printed upper side of the printed medium with the lacquered surface being outermost.

16. The method according to claim 15, wherein the transfer surface is a circumferential surface of a transfer drum.

17. The method according to claim 16, wherein the transfer drum is highly polished.

18. The method according to claim 16, wherein the transfer drum is coated with ceramic.

19. The method according to claim 1, which further comprises providing adhesive on the still-wet, freshly-printed upper side of the printed medium before the transferring step.

20. The method according to claim 19, which further comprises hardening the adhesive after applying the adhesive to the still-wet, freshly printed upper side of the printed medium.

21. The method according to claim 20, wherein the adhesive is hardened by heating.

22. The method according to claim 20, wherein the adhesive is hardened by irradiating with UV radiation.

23. The method according to claim 1, wherein the printed medium is a printed sheet.

24. A method of applying a lacquer layer to a still-wet, freshly-printed upper side of a printed medium, which comprises the steps:

forming a UV lacquer film;

hardening the UV lacquer film by UV radiating the UV lacquer film; and transferring the hardened UV lacquer film to the still-wet, freshly-printed upper side of the printed medium while simultaneously permanently adhering the UV lacquer film to the still-wet, freshly-printed upper side.

25. The method according to claim 24, which further comprises:

applying an adhesive to the hardened UV lacquer film to form a lacquer-adhesive composite film, and subsequently transferring the lacquer-adhesive composite film to the printed medium by contacting the adhesive with the still-wet, freshly-printed upper side of the printed medium.

26. The method according to claim 25, wherein the adhesive is a UV adhesive.

27. The method according to claim 25, which further comprises hardening the adhesive immediately after applying to the lacquer film.

28. The method according to claim 27, wherein the hardening of the adhesive is accomplished by heating.

29. The method according to claim 27, wherein the hardening of the adhesive is accomplished by irradiating with UV radiation.

30. The method according to claim 27, wherein the hardening of the adhesive is accomplished by irradiating with infrared radiation.

31. The method according to claim 27, wherein the hardening of the adhesive is accomplished by applying ultrasound.

32. The method according to claim 27, which further comprises hardening the adhesive after transferring the lacquer-adhesive composite film to the still-wet, freshly-printed upper side of the printed medium.

33. The method according to claim 32, wherein the hardening of the adhesive is accomplished by heating.

34. The method according to claim 32, wherein the hardening of the adhesive is accomplished by irradiating with UV radiation.

35. The method according to claim 32, wherein the hardening of the adhesive is accomplished by irradiating with infrared radiation.

36. The method according to claim 32, wherein the hardening of the adhesive is accomplished by applying ultrasound.

37. The method according to claim 25, which further comprises façon-type lacquering including producing the lacquer-adhesive composite film only in a specified region and transferring the lacquer-adhesive composite film to a corresponding region of the still-wet, freshly-printed upper side of the printed medium.

38. The method according to claim 24, which further comprises:

applying lacquer to a transfer surface to produce the UV lacquer film with a glossy lacquered surface apposing the transfer surface; and positioning the UV lacquer film on the still-wet, freshly-printed upper side of the printed medium with the lacquered surface being outermost.

39. The method according to claim 38, wherein the transfer surface is a circumferential surface of a transfer drum.

40. The method according to claim 39, wherein the transfer drum is highly polished.

41. The method according to claim 39, wherein the transfer drum is coated with ceramic.

42. The method according to claim 24, which further comprises providing adhesive on the still-wet, freshly-printed upper side of the printed medium before the transferring step.

43. The method according to claim 42, which further comprises hardening the adhesive after applying the adhesive to the still-wet, freshly-printed upper side of the printed medium.

44. The method according to claim 43, wherein the adhesive is hardened by heating.

45. The method according to claim 43, wherein the adhesive is hardened by irradiating with UV radiation.

46. The method according to claim 24, wherein the printed medium is a printed sheet.

* * * * *